US012070174B2

(12) United States Patent
Oblinger et al.

(10) Patent No.: US 12,070,174 B2
(45) Date of Patent: Aug. 27, 2024

(54) DOMESTIC DISHWASHER

(71) Applicant: BSH Hausgeräte GmbH, Munich (DE)

(72) Inventors: Anton Oblinger, Wertingen (DE); Michael Rupp, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 174 days.

(21) Appl. No.: 17/791,546

(22) PCT Filed: Jan. 13, 2021

(86) PCT No.: PCT/EP2021/050529

§ 371 (c)(1),
(2) Date: Jul. 8, 2022

(87) PCT Pub. No.: WO2021/151660

PCT Pub. Date: Aug. 5, 2021

(65) Prior Publication Data

US 2023/0035793 A1 Feb. 2, 2023

(30) Foreign Application Priority Data

Jan. 28, 2020 (DE) ..... 102020201012.9

(51) Int. Cl.
*A47L 15/42* (2006.01)

(52) U.S. Cl.
CPC ..... *A47L 15/4246* (2013.01); *A47L 15/4204* (2013.01); *A47L 15/4278* (2013.01)

(58) Field of Classification Search
None
See application file for complete search history.

(56) References Cited

U.S. PATENT DOCUMENTS

| | | | | |
|---|---|---|---|---|
| 2008/0190464 | A1 | 8/2008 | Stahlmann | |
| 2010/0219169 | A1 | 9/2010 | Heisele | |
| 2010/0269867 | A1 | 10/2010 | Buesing | |
| 2011/0155187 | A1 | 6/2011 | Oppel | |
| 2014/0069470 | A1 | 3/2014 | Baldwin | |
| 2015/0107632 | A1* | 4/2015 | Hofmann | A47L 15/4206 134/110 |
| 2020/0170480 | A1 | 6/2020 | Gebauer | |
| 2020/0214530 | A1* | 7/2020 | Callahan | A47L 15/4225 |

FOREIGN PATENT DOCUMENTS

| | | | |
|---|---|---|---|
| DE | 102010038360 | A1 | 1/2012 |
| EP | 2486841 | A2 | 8/2012 |
| EP | 2794975 | B1 | 6/2019 |
| KR | 200196940 | Y1 | 12/2000 |

OTHER PUBLICATIONS

National Search Report DE_10 2020 201 012.9 dated Oct. 29, 2020.
International Search Report PCT/EP2021/050529 dated Feb. 15, 2021.

* cited by examiner

*Primary Examiner* — Levon J Shahinian
(74) *Attorney, Agent, or Firm* — Michael E. Tschupp; Andre Pallapies; Brandon G. Braun

(57) ABSTRACT

A household dishwasher includes a dishwasher cavity, and a functional region embodied in one piece with the dishwasher cavity and processed by a laser processing method.

15 Claims, 10 Drawing Sheets

DOMESTIC DISHWASHER

CROSS-REFERENCES TO RELATED APPLICATIONS

This application is the U.S. National Stage of International Application No. PCT/EP2021/050529, filed Jan. 13, 2021, which designated the United States and has been published as International Publication No. WO 2021/151660 A1 and which claims the priority of German Patent Application, Serial No. 10 2020 201 012.9, filed Jan. 28, 2020, pursuant to 35 U.S.C. 119(a)-(d).

The contents of International Application No. PCT/EP2021/050529 and German Patent Application, Serial No. 10 2020 201 012.9 are incorporated herein by reference in their entireties as if fully set forth herein.

BACKGROUND OF THE INVENTION

The present invention relates to a household dishwasher.

A dishwasher comprises a dishwasher cavity, in which items to be washed can be received. In the dishwasher cavity, there may be provision for a filter system with a fine filter and a coarse filter, which can be removed from the dishwasher cavity for cleaning purposes. Furthermore, add-on parts, such as a supply pipe for example, may be provided on the dishwasher cavity.

BRIEF SUMMARY OF THE INVENTION

Against this background, an object of the present invention consists in providing an improved household dishwasher.

Accordingly, a household dishwasher is proposed with a dishwasher cavity and a functional region which is embodied in one piece with the dishwasher cavity and is processed with the aid of a laser processing method.

The use of a laser processing method results in a large degree of freedom when designing the functional region. This advantageously makes it possible to adapt the functional region to different application cases.

In particular, the functional region is permeable to fluid. This means that a fluid, for example washing liquor and/or fresh water, is able to pass through the dishwasher cavity at the functional region. The dishwasher cavity is preferably cuboid in shape. The dishwasher cavity comprises a base, a ceiling arranged opposite the base, two side walls arranged opposite one another, as well as a rear wall. The functional region may be provided on the base, on the ceiling, on the side walls, on one of the side walls and/or on the rear wall. A plurality of functional regions may be provided.

In the present case, a "laser processing method" is preferably to be understood as meaning a separating manufacturing method using a laser processing machine.

In this context, the functional region is attached to the dishwasher cavity with the aid of the laser processing method. The functional region being embodied "in one piece" with the dishwasher cavity is to be understood in the present case in particular as meaning that the functional region and the dishwasher cavity form a common component and not two components that are separate from one another. This means that the functional region preferably cannot be separated from the dishwasher cavity.

In accordance with one embodiment, the functional region is a filter area with a perforation, provided on a base of the dishwasher cavity.

The functional region in particular may be part of a filter system of the household dishwasher. For example, the functional region may be a fine filter of the filter system. The filter system may further comprise a coarse dirt separator or coarse filter which can be removed from the dishwasher cavity of the household dishwasher. In the present case, a "perforation" is to be understood as meaning a large number of openings, holes or bores, which together all form the perforation. The perforation is introduced into the base with the aid of the laser processing method. In particular, the functional region is part of the base.

In accordance with a further embodiment, the perforation has openings that pierce through the base, wherein a size of the openings within the perforation is variable.

For example, the openings may have a circular cross-section. However, the openings may have any given geometry. In the present case, the openings within the perforation being "variable" means that the openings of the perforation do not all have the same size, but may have different sizes.

In accordance with a further embodiment, the size of the openings decreases toward a center of the functional region, starting from an edge of the functional region.

The previously mentioned coarse dirt separator may be provided at the center of the functional region. A flow direction of the washing liquor and/or the fresh water is oriented in the direction of the center, starting from the edge. This means that the size of the openings decreases when viewed along the flow direction. Thus, it is possible to achieve a size gradient of the openings in the direction of the center or along the flow direction, starting from the edge. It is preferably possible to adapt a size gradient of this kind in a flexible manner with the aid of the laser processing method, in order to thus achieve an optimum filter result. In the event that the openings are circular, a diameter gradient may be provided.

In accordance with a further embodiment, the openings widen in each case toward the center of the functional region, starting from the edge of the functional region.

This means that the openings widen when viewed along the flow direction. For example, the openings may have a triangular geometry, the cross-section of which widens when viewed along the flow direction. This makes it possible to achieve a self-cleaning effect of the openings. The functional region is thus maintenance-free.

In accordance with a further embodiment, through-holes which differ from the openings in terms of their geometry and their size are provided at the edge of the functional region.

The through-holes may be part of the functional region. The through-holes are preferably several times the size of the openings. The through-holes may be rectangular or slot-shaped, for example. With the aid of the through-holes, it is possible to achieve a flushing of a pump sump of the household dishwasher. The pump sump can be cleaned as a result, making this maintenance-free.

In accordance with a further embodiment, a pump sump is attached to the base, which is connected to the base with a positive fit and/or material fit.

In particular, the pump sump is positioned below the functional region. A positive-fit connection is produced by way of the interlocking or rear engagement of two connection partners, in the present case the base and the pump sump. For example, an engagement element in the form of a latching hook or snap hook, which engages into a mating engagement section of the base with a positive fit, is provided on the pump sump. The pump sump may be connected to the base with the aid of a screw connection, a rivet connection, a crimp connection and/or a clinch connection, for example. Furthermore, the pump sump may be connected to the base with a material fit, in particular adhesively bonded. In the case of material-fit connections, the connection partners are held together by way of atomic or molecular forces. Material-fit connections are non-detachable connections, which can only be separated by destroying the connection means and/or the connection partners.

In accordance with a further embodiment, the pump sump has a dirt-resistant surface.

The dirt-resistant surface faces toward the functional region. Due to the surface being dirt-resistant, it is possible to dispense with a cleaning of the pump sump. Thus, the pump sump is self-cleaning and maintenance-free.

In accordance with a further embodiment, the dirt-resistant surface is hydrophobic, microstructured, plasma-coated and/or nano-coated.

In the present case, "hydrophobic" means "water-repelling". This means that washing liquor and/or fresh water striking the surface drips off of said surface. A scale-like microstructure in the manner of sharkskin may be provided, for example.

In accordance with a further embodiment, the pump sump is manufactured from a plastic material filled with nanoparticles.

In particular, the pump sump is a plastic injection-molded component. The nanoparticles lead to the surface of the pump sump being dirt-resistant.

In accordance with a further embodiment, the functional region has at least one through-hole provided on the dishwasher cavity.

The through-hole may be circular or have any other given geometry, for example. The through-hole is introduced into the dishwasher cavity with the aid of the laser processing method. Any given number of through-holes may be provided.

In accordance with a further embodiment, the functional region has at least one connection molded onto the dishwasher cavity, wherein the at least one through-hole is provided on the at least one connection.

Preferably, the connection is first molded onto the dishwasher cavity, and subsequently the through-hole is introduced into the connection with the aid of the laser processing method.

In accordance with a further embodiment, the at least one connection is provided on the outside of the dishwasher cavity.

This means that the connection bulges out of the dishwasher cavity on the outside. For example, the connection may be provided on one of the side walls or on the rear wall of the dishwasher cavity.

In accordance with a further embodiment, add-on parts are assembled on the at least one connection.

In particular, the add-on parts are plastic add-on parts. The add-on parts may comprise a supply pipe and/or an inlet pipe, for example.

In accordance with a further embodiment, the functional region has an exhaust vent molded onto the dishwasher cavity.

The exhaust vent is preferably molded onto the base of the dishwasher cavity. The exhaust vent has at least one through-hole introduced with the aid of the laser processing method. Due to the exhaust vent being molded directly onto the dishwasher cavity, it is possible to dispense with a separate exhaust vent cap.

Further possible implementations of the household dishwasher also comprise combinations—not explicitly cited—of features or embodiments described above or below in respect of the exemplary embodiments. In this context, the person skilled in the art will also add individual aspects as improvements or enhancements to the respective basic form of the household dishwasher.

BRIEF DESCRIPTION OF THE DRAWINGS

Further advantageous embodiments and aspects of the household dishwasher form the subject matter of the subclaims and of the exemplary embodiments of the household dishwasher that are described below. The household dishwasher is described in greater detail below using preferred embodiments with reference to the accompanying figures, in which:

DETAILED DESCRIPTION OF EXEMPLARY EMBODIMENTS OF THE PRESENT INVENTION

Figure 1:
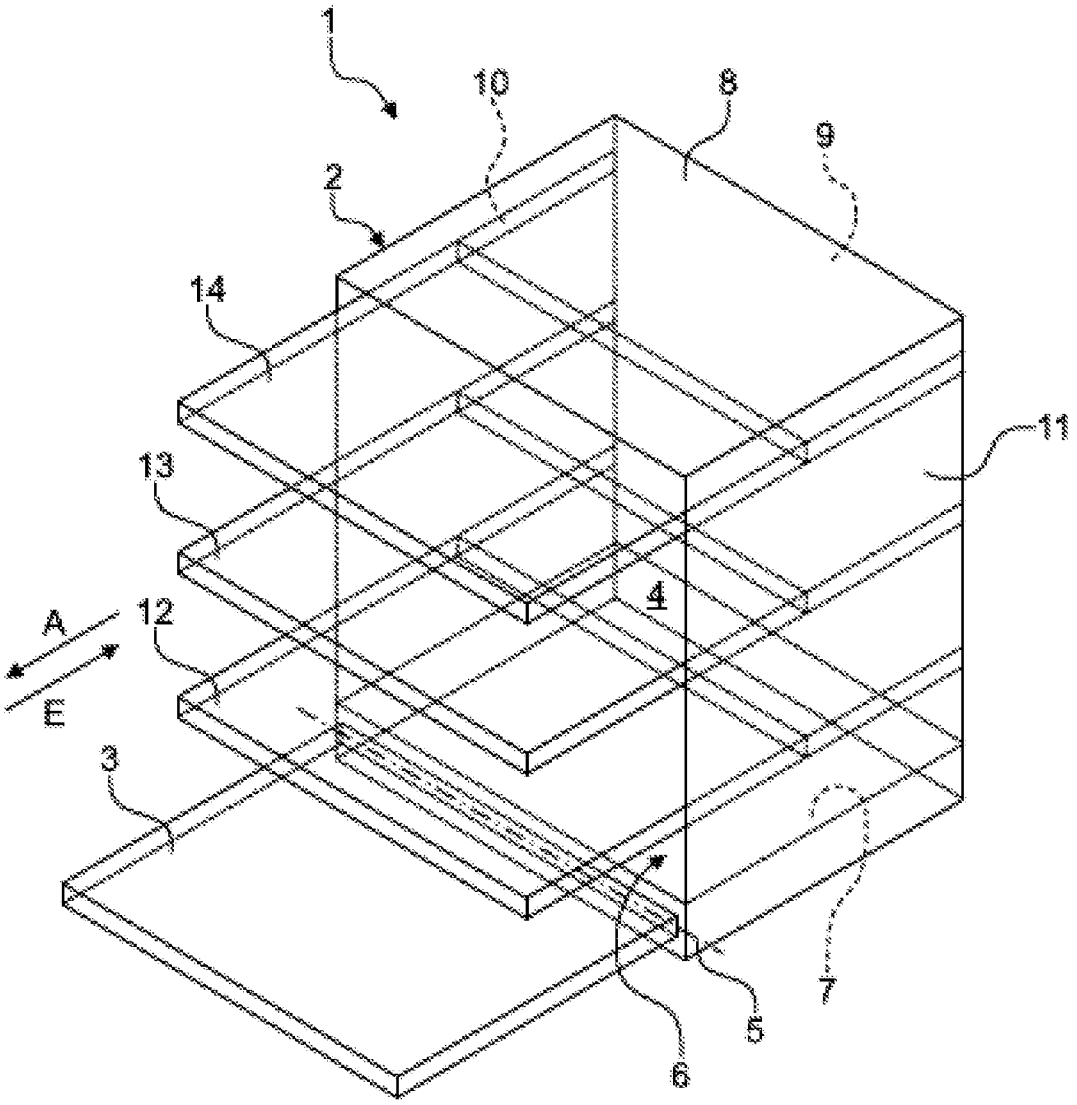
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed off by a door 3, in particular in a watertight manner.

To this end, a sealing facility can be provided between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a dishwasher interior 4 for washing items to be washed.

The door 3 is shown in its opened position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a base 7, a ceiling 8 arranged opposite the base 7, a rear wall 9 arranged opposite the closed door 3 and two side walls 10, 11 arranged opposite one another. The base 7, the ceiling 8, the rear wall 9 and the side walls 10, 11 can be manufactured from a stainless-steel sheet, for example.

Furthermore, the household dishwasher 1 has at least one receptacle for items to be washed 12, 13, 14. Preferably, a plurality of receptacles for items to be washed 12, 13, 14, for example three, can be provided, wherein the receptacle for items to be washed 12 can be a lower receptacle for items to be washed or a lower basket, the receptacle for items to be washed 13 can be an upper receptacle for items to be washed or an upper basket, and the receptacle for items to be washed 14 can be a cutlery drawer. As additionally shown in FIG. 1, the receptacles for items to be washed 12, 13, 14 are arranged one above the other in the dishwasher cavity 2. Each receptacle for items to be washed 12, 13 14 is optionally able to be shifted into or out from the dishwasher cavity 2. In particular, each receptacle for items to be washed 12, 13, 14 can be inserted or moved into the dishwasher cavity 2 in an insertion direction E (arrow) and extracted or moved out from the dishwasher cavity 2 against the insertion direction E (arrow) in an extraction direction A (arrow).

Figure 2:
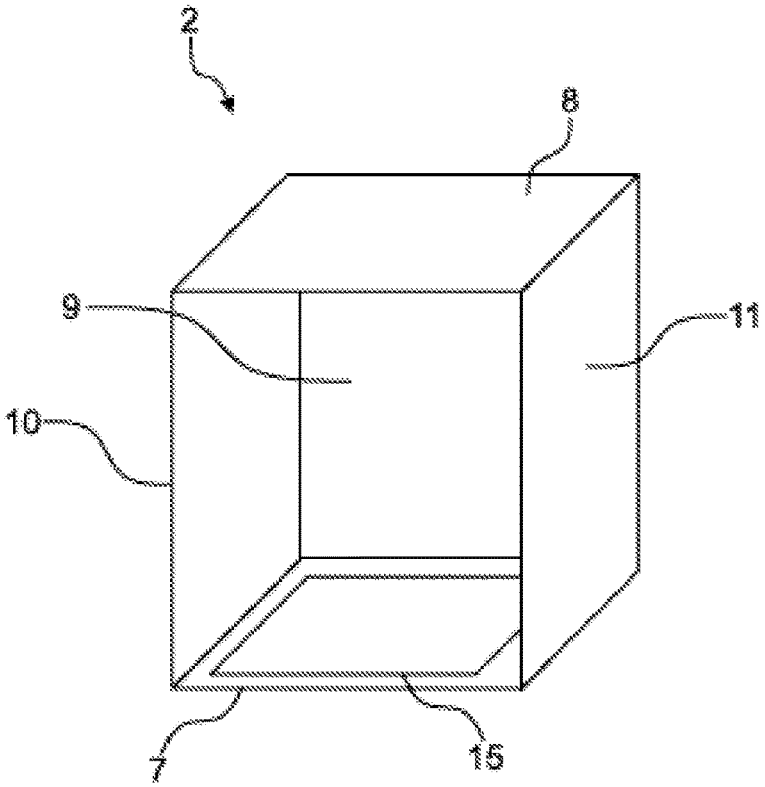
FIG. 2 shows a schematic perspective view of an embodiment of a dishwasher cavity for the household dishwasher in accordance with FIG. 1.
Figure 3:
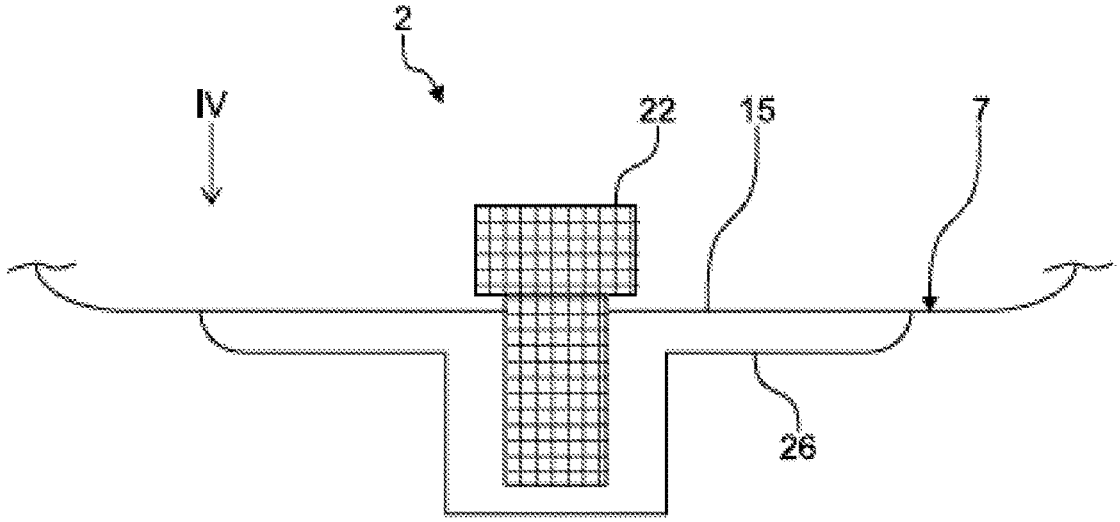
FIG. 3 shows a schematic partial sectional view of the dishwasher cavity in accordance with FIG. 2.
Figure 4:
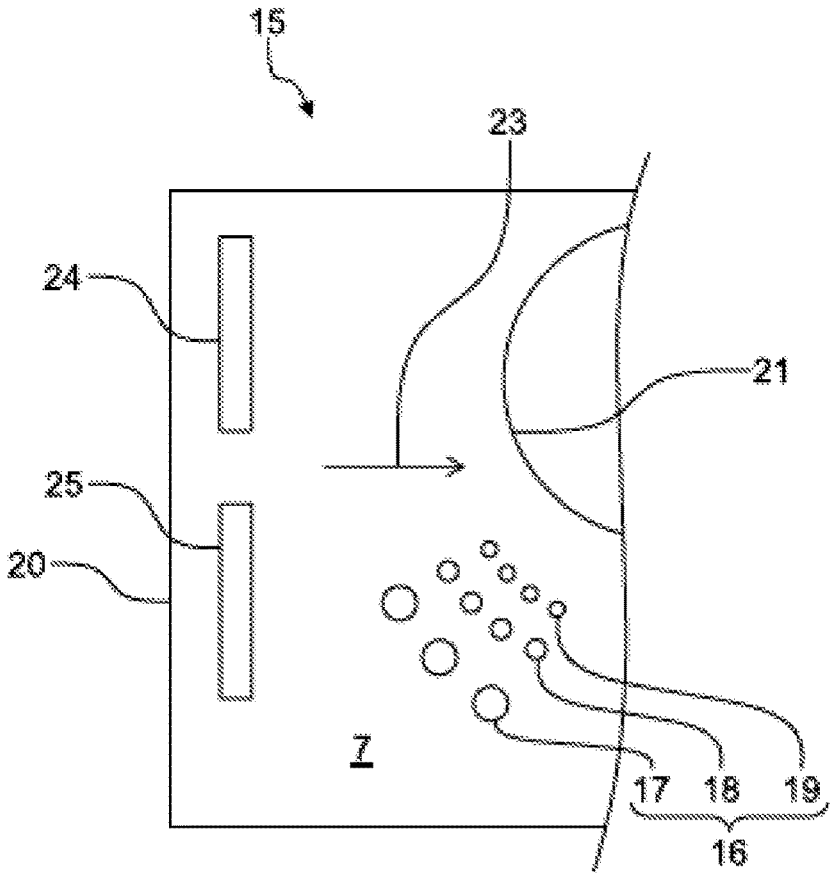
FIG. 4 shows a schematic top view of an embodiment of a functional region for the dishwasher cavity in accordance with FIG. 2.
Figure 5:
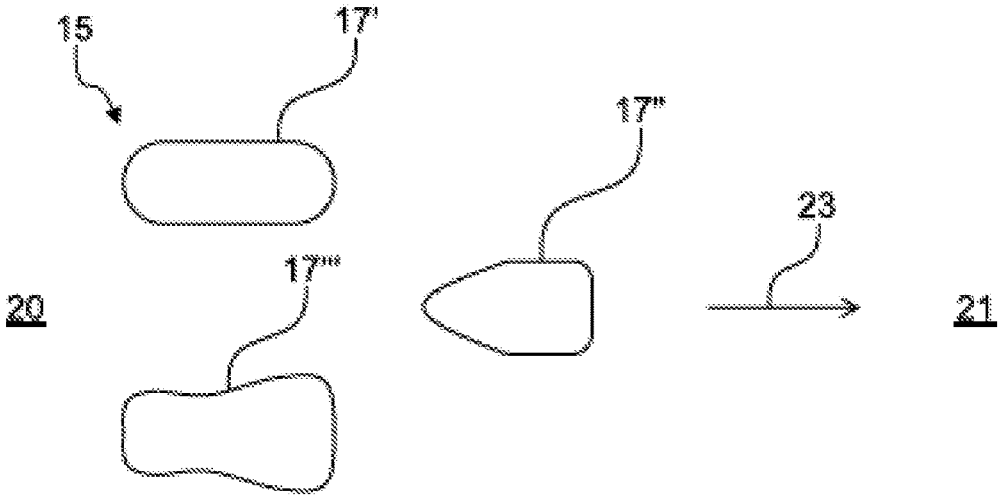
FIG. 5 shows a schematic top view of a further embodiment of a functional region for the dishwasher cavity in accordance with FIG. 2.
Figure 6:
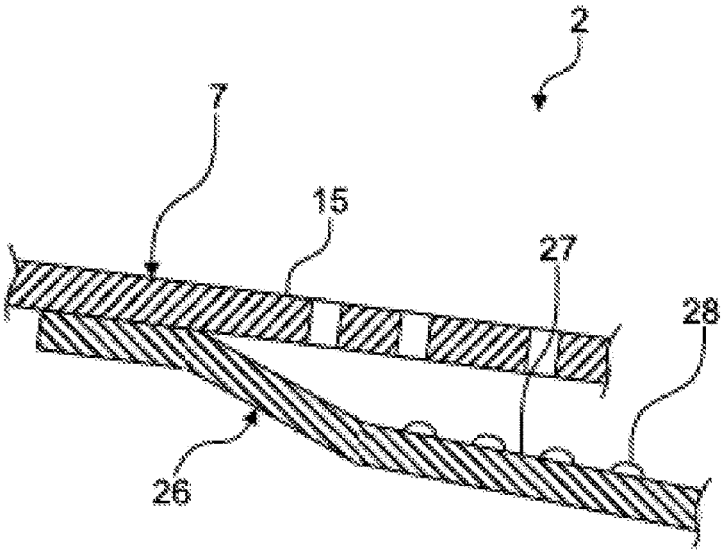
FIG. 6 shows a further schematic partial sectional view of the dishwasher cavity in accordance with FIG. 2.

FIG. 2 shows a schematic perspective view of an embodiment of a dishwasher cavity 2 as previously explained. FIG. 3 shows a schematic partial sectional view of the dishwasher cavity 2. FIG. 4 shows the top view IV in accordance with FIG. 3. FIG. 5 again shows the top view IV, in a development. FIG. 6 shows a further schematic partial sectional view of the dishwasher cavity 2. Reference is made below simultaneously to FIGS. 2 to 6.

A functional region 15 is provided on the base 7 of the dishwasher cavity 2. In particular, the functional region 15 is a filter area, with a perforation 16, provided on the base 7 of the dishwasher cavity 2 (FIG. 4). Preferably, the functional region 15 is a fine filter of the household dishwasher 1. The perforation 16 comprises a large number of openings 17, 18, 19 that pierce through the base 7, of which only three are provided with a reference character in FIG. 4. The perforation 16 is introduced into the base 7 with the aid of a laser processing method. To this end, a laser processing machine is used. In the present case, a "laser processing machine" is understood as meaning a machine tool which processes materials with the aid of a high-energy laser beam. The perforation 16 may also be referred to as laser perforation.

The functional region 15 comprises an edge 20 as well as a center 21. Provided at or in the center 21 is a removable coarse dirt separator 22, as shown in FIG. 3. The coarse dirt separator 22 is a coarse filter of the household dishwasher 1 or may be referred to as such. A size of the openings 17, 18, 19 decreases in the direction of the center 21 or along a flow direction 23 (arrow), starting from the edge 20. In this context, the flow direction 23 (arrow) is oriented from the edge 20 in the direction of the center 21. In the event that the openings 17, 18, 19 are circular, this means that a respective diameter of the openings 17, 18, 19 decreases in the direction of the center 21 or along the flow direction 23 (arrow), starting from the edge 20.

This decreasing of the size, in particular of the diameter, of the openings 17, 18, 19 may be referred to as size gradient, in particular as diameter gradient, of the openings 17, 18, 19. The size gradient or diameter gradient is oriented from the edge 20 in the direction of the center 21 or along the flow direction 23 (arrow). This means, as mentioned previously, that the size of the openings 17, 18, 19 decreases from the edge 20 in the direction of the center 21 or along the flow direction 23 (arrow). The openings 17, 18, 19, as mentioned previously, may be circular or have any other given geometry.

Furthermore, the openings 17, 18, 19 may widen in the direction of the center 21 or along the flow direction 23 (arrow), starting from the edge 20. In this context, "widen" means that a cross-section or a cross-sectional area of the respective opening 17, 18, 19 becomes larger or wider in the direction of the center 21 or along the flow direction 23 (arrow), starting from the edge 20. To this end, the openings 17, 18, 19 may have different geometries, which are referred to with the reference characters 17', 17" and 17'" in FIG. 5. The openings 17, 18, 19 may be triangular or mushroom-shaped, for example. The openings 17, 18, 19 may also be oval. Due to this adapted geometry of the openings 17, 18, 19, it is possible to achieve a self-cleaning of the functional region 15. The functional region 15 is thus maintenance-free and does not have to be removed from the dishwasher cavity 2 for cleaning purposes.

Through-holes 24, 25 (FIG. 4), which differ from the openings 17, 18, 19 in terms of their geometry and their size, are provided on the edge side of the functional region 15. Preferably, the through-holes 24, 25 are larger than the openings 17, 18, 19. The through-holes 24, 25 may be rectangular. The through-holes 24, 25 may also be referred to as protective perforations. The through-holes 24, 25 ensure a rapid supply of washing liquor and/or fresh water to a pump pot or pump sump 26 provided on the base 7 (FIG. 3). This makes it possible to achieve a backwashing or a cleaning of the pump sump 26. The pump sump 26 is thus maintenance-free.

The pump sump 26 is arranged below the functional region 15. A recirculating pump may be provided on the pump sump 26. The pump sump 26 may have a dirt-resistant surface 27 facing toward the functional region 15 (FIG. 6). The surface 27 may comprise a microstructure 28. The surface 27 may be hydrophobic, microstructured, plasma-coated and/or nano-coated. Furthermore, the pump sump 26 may be manufactured from a plastic material filled with nanoparticles. The microstructure 28 of the surface 27 may be embodied in the manner of a sharkskin, for example. This microstructure 28 improves the flow dynamics and ensures that the pump sump 26 does not become dirty. The pump sump 26 is thus maintenance-free.

Figure 7:
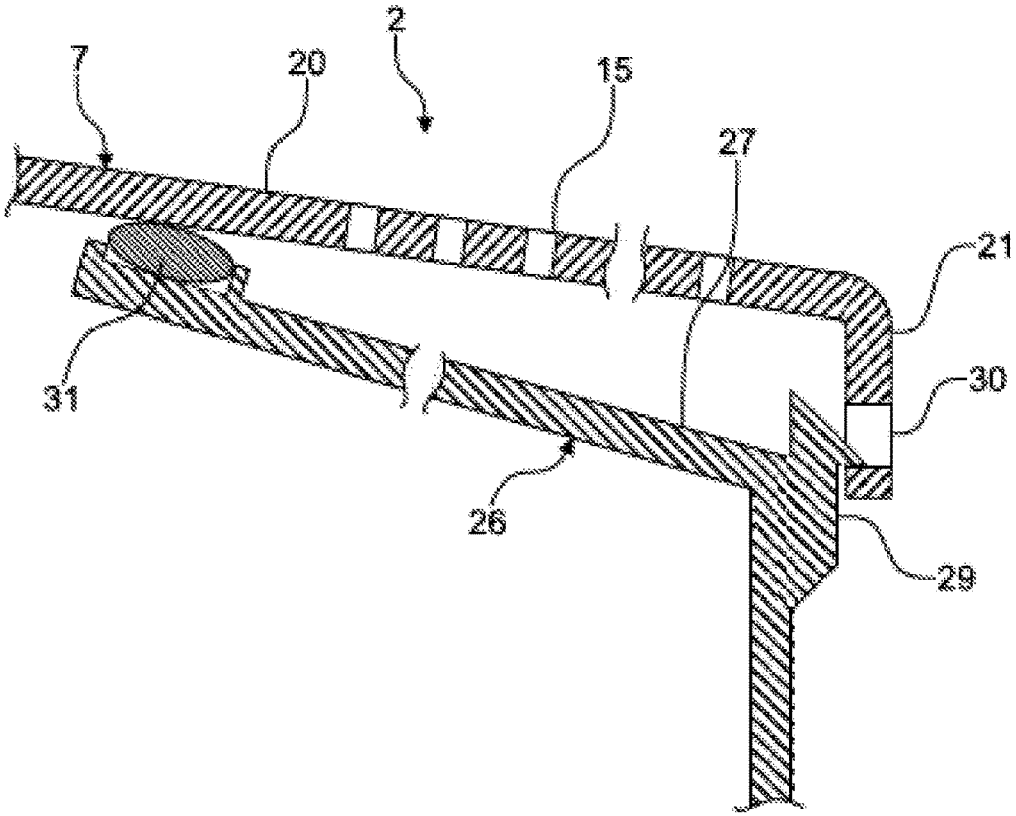
FIG. 7 shows a further schematic partial sectional view of the dishwasher cavity in accordance with FIG. 2.

FIG. 7 shows a partial sectional view of the dishwasher cavity 2 in the region of the base 7. In this context, the pump sump 26 comprises an engagement element 29 in the form of a snap hook or latching hook. The engaging element 29 engages with a positive fit into a corresponding mating engagement element 30, for example into a cutout, of the base 7 or the functional region 15. A positive-fit connection is produced by way of the interlocking or rear engagement of two connection partners, in the present case the engagement element 29 and the mating engagement element 30. This makes it possible to achieve a prefixing of the pump sump 26 in the region of the coarse dirt separator 22 or the center 21 of the functional region 15. At the edge 20 of the functional region 15, with the aid of an adhesive connection 31, the pump sump is adhesively bonded to the base 7 and sealed off therefrom.

Figure 8:
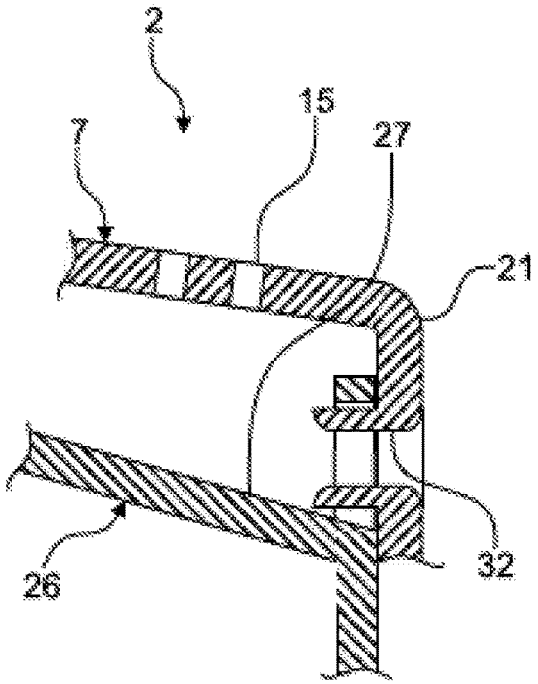
FIG. 8 shows a further schematic partial sectional view of the dishwasher cavity in accordance with FIG. 2.

In a further schematic partial sectional view, FIG. 8 shows an alternative possibility for connecting the pump sump 26 to the base 7. In this context, the pump sump is connected to the pump sump 26 with the aid of a clinch connection 32. The clinch connection 32 may also be referred to as TOX connection. A plurality of clinch connections 32 may be provided.

Figure 9:
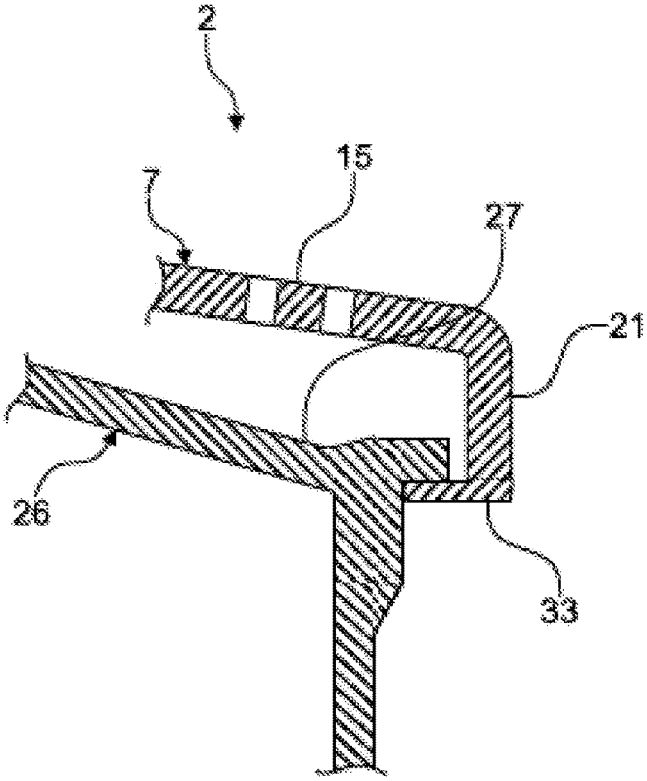
FIG. 9 shows a further schematic partial sectional view of the dishwasher cavity in accordance with FIG. 2.

In a further schematic partial sectional view, FIG. 9 shows a further alternative manner of connecting the pump sump 26 to the base 7. In this case, a crimp connection 33 for connecting the base 7 to the pump sump 26 is provided in the region of the coarse dirt separator 22 or the center 21.

Figure 10:
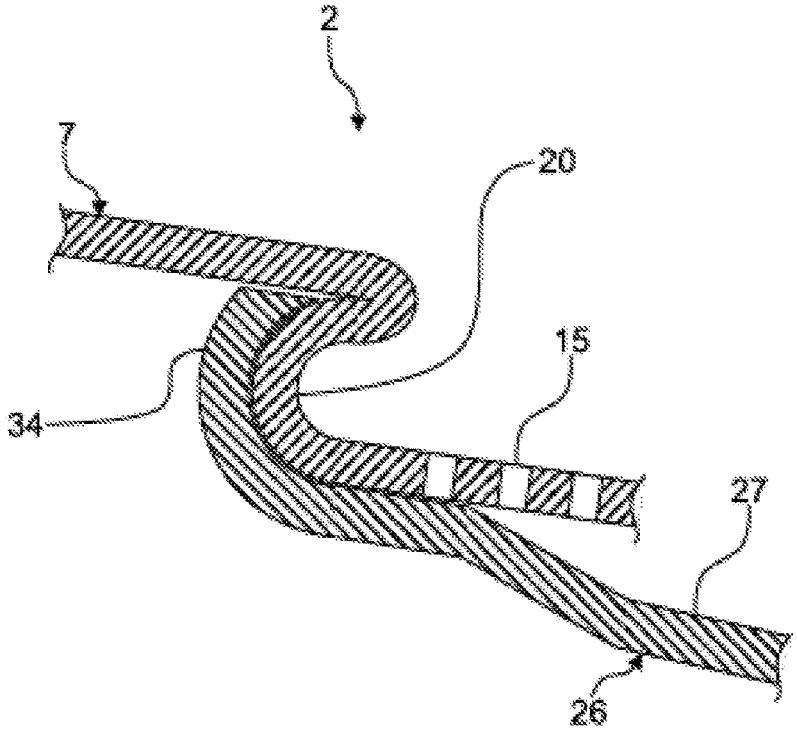
FIG. 10 shows a further schematic partial sectional view of the dishwasher cavity in accordance with FIG. 2.

In a further schematic partial sectional view, FIG. 10 shows a further alternative manner of connecting the pump sump 26 to the base 7. In this context, a peripheral clinch connection 34 is provided at the edge 20 of the functional region 15. In this context, the base 7 is reshaped in such a manner that the base 7 and the pump sump 26 interlock and are sealed off from one another in a fluid-tight manner. Thermoforming may also be used.

Figure 11:
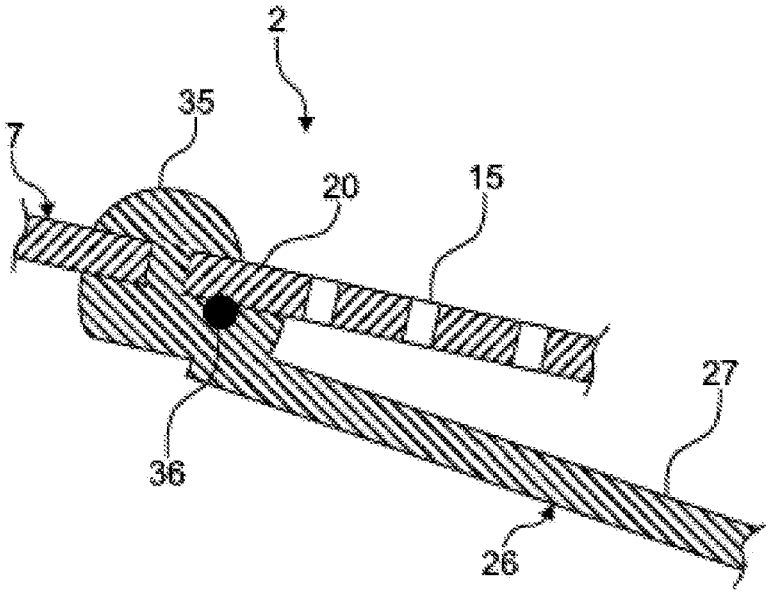
FIG. 11 shows a further schematic partial sectional view of the dishwasher cavity in accordance with FIG. 2.

In a further schematic partial sectional view, FIG. 11 shows a further alternative manner of connecting the pump sump 26 to the base 7. In this context, hot caulking 35 is provided in the region of the edge 20 of the functional region 15. In addition, a seal 36 is provided, for example in the form of a caulking strip or an adhesive.

Figure 12:
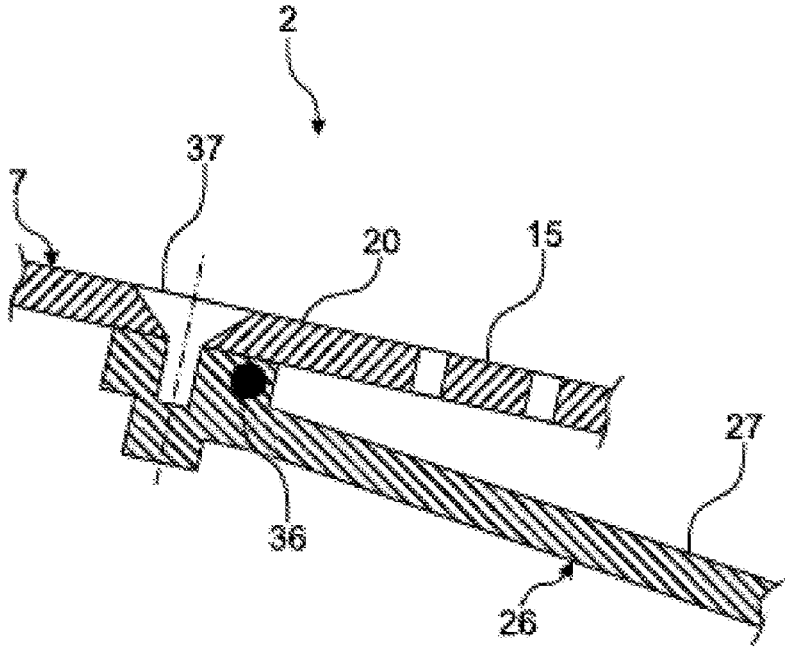
FIG. 12 shows a further schematic partial sectional view of the dishwasher cavity in accordance with FIG. 2.

In a further schematic partial sectional view, FIG. 12 shows a further alternative manner of connecting the pump sump 26 to the base 7. To this end, a screw connection 37 is provided on the edge side of the functional region 15. In addition, the previously mentioned seal 36 may be provided.

Figure 13:
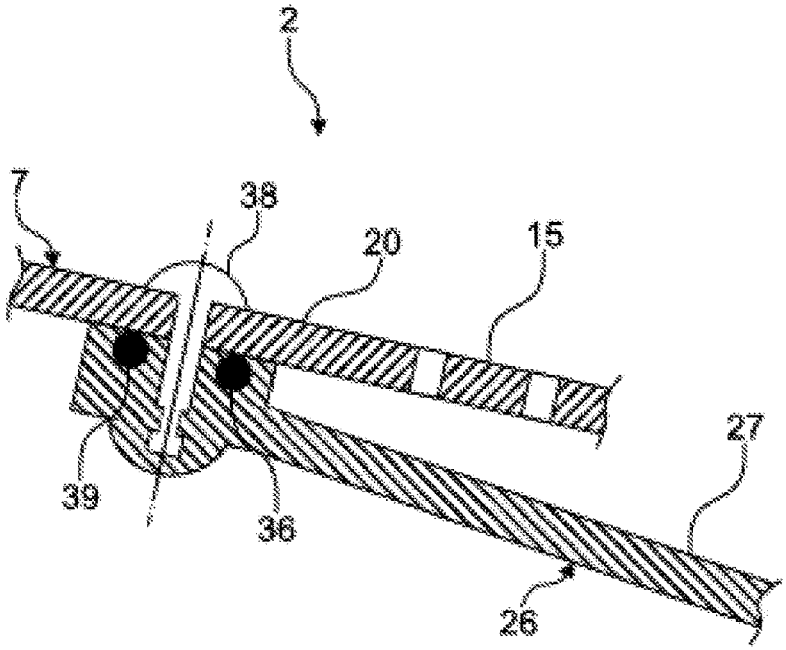
FIG. 13 shows a further schematic partial sectional view of the dishwasher cavity in accordance with FIG. 2.

In a further schematic partial sectional view, FIG. 13 shows a further alternative manner of connecting the pump sump 26 to the base 7. In this context, a rivet connection 38 is provided, which is arranged at the edge 20 of the functional region 15. The rivet connection 38 may be either a cold rivet connection or a hot rivet connection. Furthermore, the previously mentioned seal 36 is provided. In addition, another further seal 39 may be provided, which is arranged in such a manner that the rivet connection 38 is arranged between the two seals 36, 39.

Figure 14:
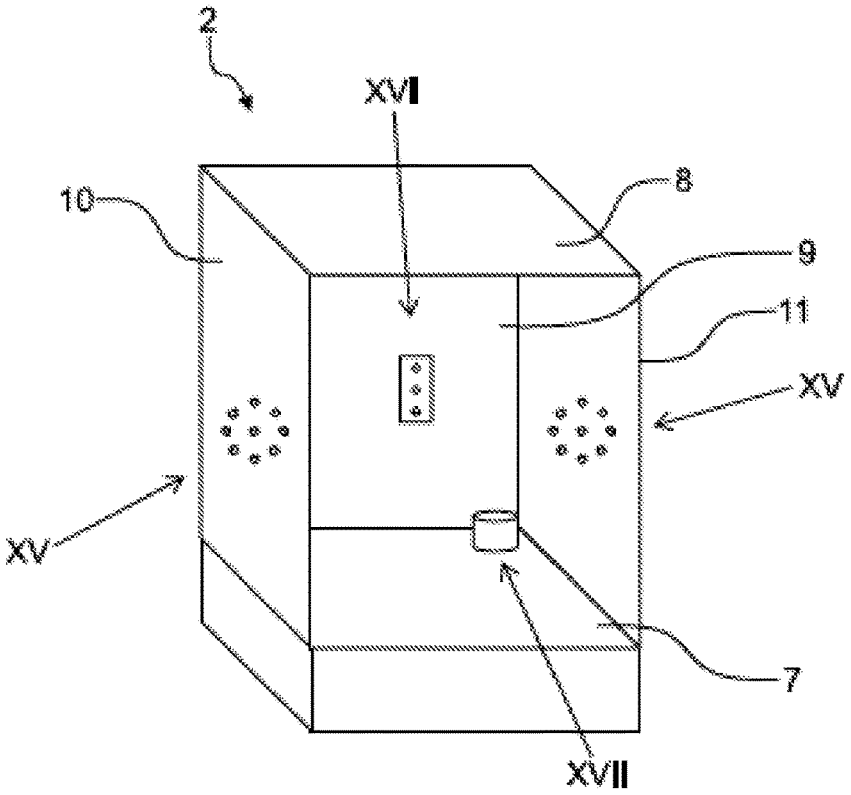
FIG. 14 shows a schematic perspective view of a further embodiment of a dishwasher cavity for the household dishwasher in accordance with FIG. 1.
Figure 15:
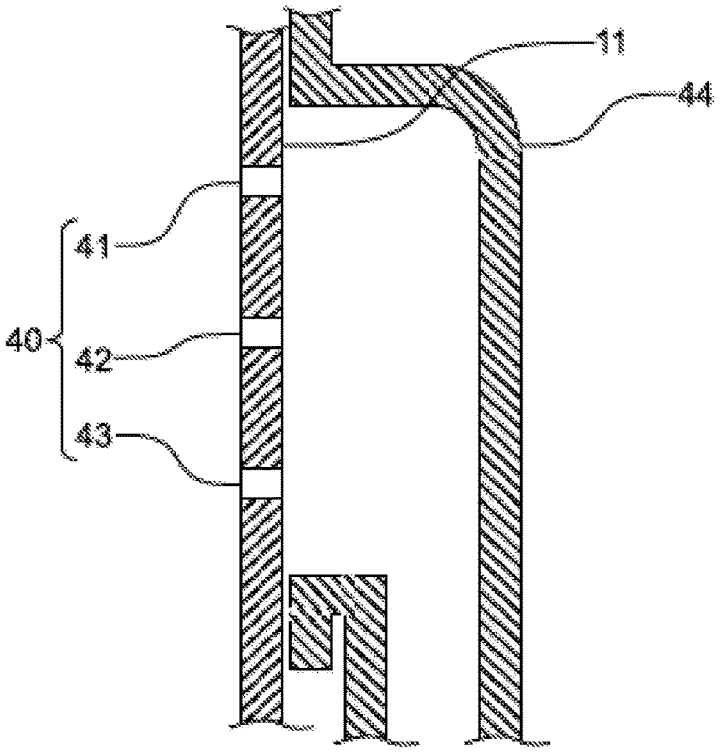
FIG. 15 shows the detail view XV in accordance with FIG. 14.
Figure 16:
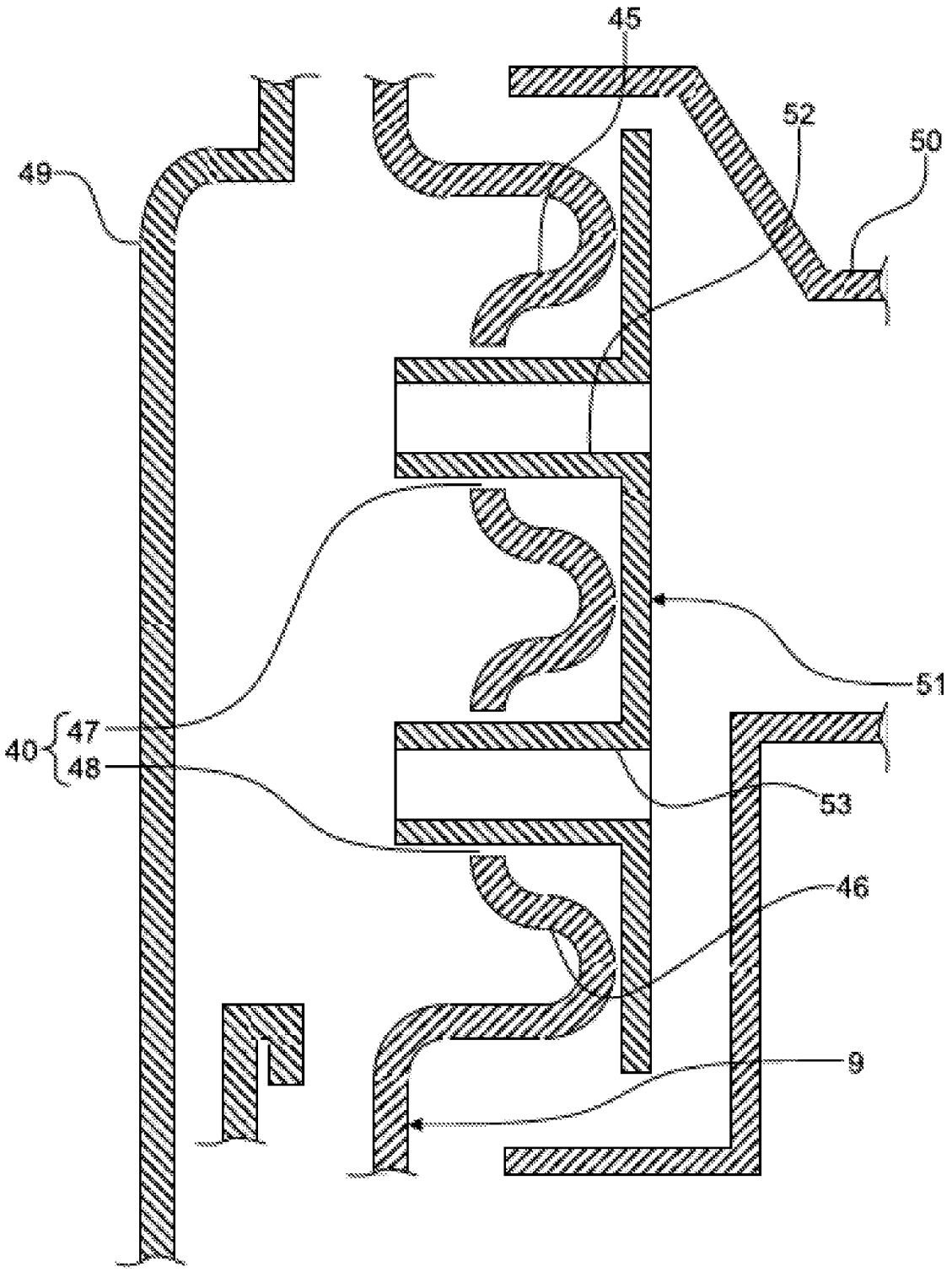
FIG. 16 shows the detail view XVI in accordance with FIG. 14.
Figure 17:
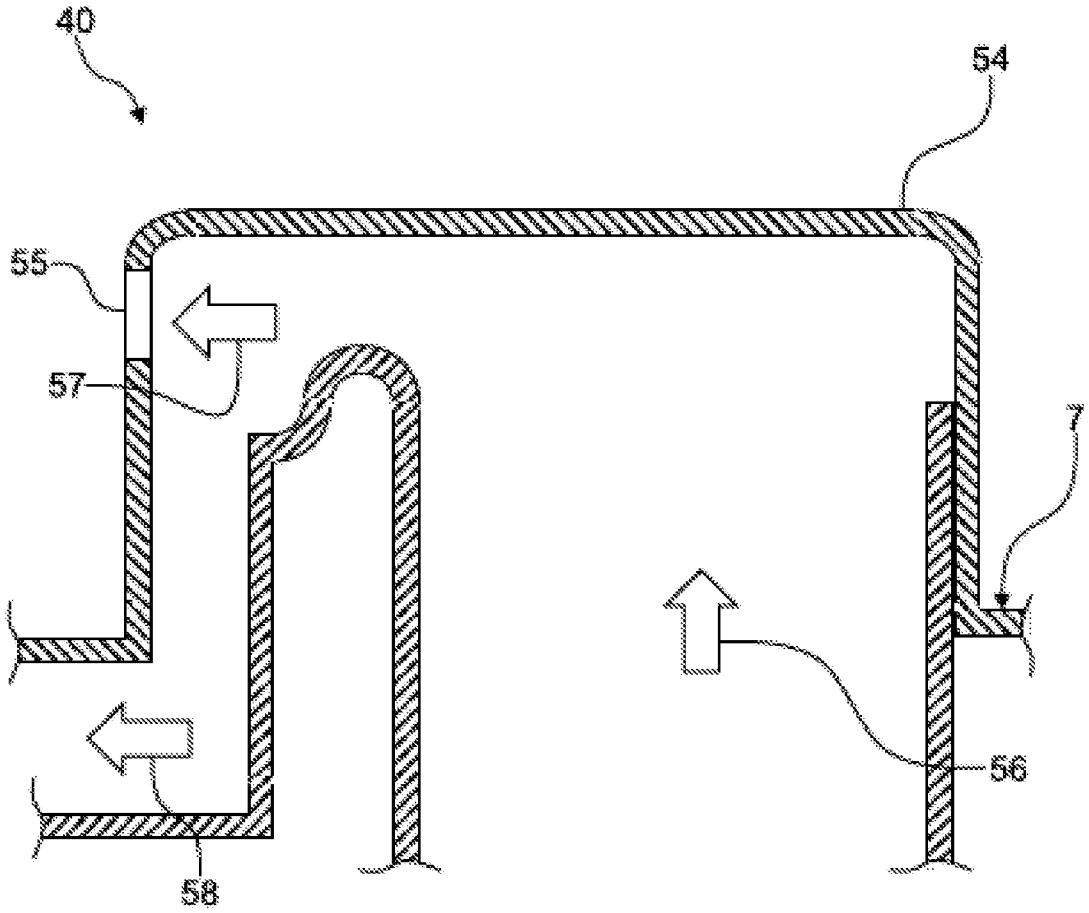
FIG. 17 shows the detail view XVII in accordance with FIG. 14.

FIG. 14 shows a schematic perspective view of a further embodiment of a dishwasher cavity 2 as previously explained. FIG. 15 shows the detail view XV in accordance with FIG. 14. FIG. 16 shows the detail view XVI in accordance with FIG. 14, and FIG. 17 shows the detail view XVII in accordance with FIG. 15.

As shown in FIG. 15, there may be provision for a functional region 40 comprising a plurality of through-holes 41, 42, 43 on one of the side walls 10, 11 or on both side walls 10, 11. The through-holes 41, 42, 43 are embodied as laser-manufactured through-holes.

An add-on part 44, for example in the form of an expansion guide, an intake duct, injection nozzles, a sensor bracket, a light guide or the like, may be provided on the outside of the respective side wall 10, 11. The functional region 40 is molded directly onto the dishwasher cavity 2 and is cut with the aid of a laser processing method. The add-on part 44 may be attached to the outside of the dishwasher cavity 2 in a fully automated manner and does not form an interfering factor in terms of design, quality and/or functionality. The add-on part 44 is preferably a plastic component.

As shown in FIG. 16, the functional region 40 may also be provided on the rear wall 9 of the dishwasher cavity 2. In this context, connections 45, 46 may be molded onto the rear wall 9 and subsequently cut with the aid of a laser processing method, meaning that a functional region 40 with through-holes 47, 48 is produced. The through-holes 47, 48 are introduced with the aid of the laser processing method. An add-on part 49 in the form of a supply pipe is provided on the outside of the dishwasher cavity 2. An add-on part 50 in the form of an inlet pipe is provided on the inside of the dishwasher cavity 2. The add-on part 50 may have a spray arm mounted in a rotatable manner, for example, which is suitable for distributing washing liquor and/or fresh water in the dishwasher cavity 2. A further add-on part 51 is provided between the two add-on parts 49, 50. The add-on part 51 comprises two connections 52, 53, which are guided through the connections 45, 46. The add-on parts 49, 50, 51 are preferably plastic components.

As shown in FIG. 17, the functional region 40 may also be provided on the base 7, wherein an exhaust vent 54, which is provided with a through-hole 55 with the aid of a laser processing method, is molded on the base 7. A guiding of air in the exhaust vent 54 is indicated with the aid of arrows 56, 57. A drainage line to a pump system of the household dishwasher 1 is indicated with the aid of an arrow 58.

Due to the integrated connections 45, 46, openings 17, 18, 19 and through-holes 24, 25, 41, 42, 43, 47, 48 and 55, a wide variety of possibilities are available for the design of the dishwasher cavity 2. The end customer appreciates an increase in value due to being able to dispense with additional plastic parts. The add-on parts 44, 49, 50, 51 can be assembled in a fully automated manner during pre-assembly, and with a significant quality advantage. It is possible to use novel connection methods with adhesive bonding and laser welding or the like. Assembly volumes can be shifted from final assembly to pre-assembly, simplifying the final assembly as a result.

Furthermore, connections and openings can be simplified due to the consolidation of functions. For example, a separate exhaust cap made of stainless steel is no longer necessary. Furthermore, requirements in terms of density can be optimally resolved by new connections and drainage lines. Furthermore, new sensors, light elements or other new features can be integrated in a simplified manner, due to a flexible laser cutting being established during pre-manufacture. The assembly and wiring of these elements may take place in a fully automated manner in the outer region.

Although the present invention has been described with reference to exemplary embodiments, it can be modified in numerous different ways.

What is claimed is:

1. A household dishwasher, comprising:

a dishwasher cavity; and a functional region embodied in one piece with the dishwasher cavity and processed by a laser processing method, the functional region comprising:

one or more connections molded onto a wall of the dishwasher cavity to receive an add-on part of the household dishwasher; and one or more through-holes corresponding to the one or more connections on the dishwasher cavity, the one or more through-holes being provided on a respective connection of the one or more connections integrated with the dishwasher cavity.

2. The household dishwasher of claim 1, wherein the functional region is a filter area having a perforation and provided on a base of the dishwasher cavity.

3. The household dishwasher of claim 2, wherein the perforation has openings that pierce through the base and have a respective size which is variable within the perforation.

4. The household dishwasher of claim 3, wherein the respective size of the openings decreases toward a center of the functional region, starting from an edge of the functional region, to form a size gradient associated with the openings.

5. The household dishwasher of claim 4, wherein the openings each widen toward the center of the functional region, starting from the edge of the functional region.

6. The household dishwasher of claim 3, wherein the functional region has at an edge thereof one or more protective perforations of a geometry and size which differ from a geometry and the size of the openings, and wherein the household dishwasher comprises a pump sump positioned to receive a fluid supply via the one or more protective perforations to clean the pump sump.

7. The household dishwasher of claim 2, further comprising a pump sump attached to the base and connected to the base with a positive fit and/or material fit.

8. The household dishwasher of claim 7, wherein the pump sump has a dirt-resistant surface.

9. The household dishwasher of claim 8, wherein the dirt-resistant surface is hydrophobic, microstructured, plasma-coated and/or nano-coated.

10. The household dishwasher of claim 9, wherein the dirt-resistant surface comprises one or more projected components positioned on the dirt-resistant surface to modify flow dynamics to provide dirt-resistant properties.

11. The household dishwasher of claim 7, wherein the pump sump is manufactured from a plastic material filled with nanoparticles.

12. The household dishwasher of claim 1, wherein the one or more connections are provided on an outside of the dishwasher cavity.

13. The household dishwasher of claim 1, further comprising the add-on part assembled on at least one of the one or more connections, wherein the add-on part comprises one or more corresponding connections to couple to the one or more connections of the functional region.

14. The household dishwasher of claim 1, wherein the functional region includes an exhaust vent molded onto the dishwasher cavity.

15. The household dishwasher of claim 1, wherein the functional region and the dishwasher cavity form a common component such that the functional region is inseparable from the dishwasher cavity.

* * * * *